US005772095A

United States Patent [19]

Nordlof

[11] Patent Number: 5,772,095

[45] Date of Patent: Jun. 30, 1998

[54] ROLL TYPE STOCK FEED APPARATUS

[75] Inventor: Richard D. Nordlof, Rockford, Ill.

[73] Assignee: Mechanical Tool & Engineering Co., Rockford, Ill.

[21] Appl. No.: 779,805

[22] Filed: Jan. 8, 1997

[51] Int. Cl.[6] ..... B65H 20/24; B65H 20/00

[52] U.S. Cl. ..... 226/109; 226/177; 226/187; 226/188

[58] Field of Search ..... 226/109, 176, 226/177, 181, 187, 188

[56] References Cited

U.S. PATENT DOCUMENTS

| | | | |
|---|---|---|---|
| 2,693,273 | 11/1954 | Kopplin | 226/177 |
| 3,942,698 | 3/1976 | Hattori et al. | 226/176 X |
| 4,043,494 | 8/1977 | Bickford et al. | 226/109 |
| 4,759,485 | 7/1988 | Braun et al. | 226/176 |
| 5,072,872 | 12/1991 | Casset et al. | 226/176 |
| 5,197,645 | 3/1993 | Nordlof | 226/154 |
| 5,305,938 | 4/1994 | Nordlof | 226/181 |

*Primary Examiner*—Michael Mansen
*Attorney, Agent, or Firm*—Vernon J. Pillote

[57] ABSTRACT

A roll type stock feed apparatus having a lower feed roll rotatably supported on a frame and cross-shaft rotatably mounted on the frame parallel to the lower feed roll, and a motor for driving the lower feed roll and the cross-shaft in timed relation. First and second upper roll carriers are mounted for independent vertical pivotal movement on the cross-shaft, and first and second upper feed rolls are rotatably mounted on the upper roll carriers for movement therewith and are drivingly connected to the cross-shaft for rotation by the cross-shaft in timed relation with the lower feed roll. The first and second feed rolls are independently driven from the cross-shaft by first and second upper roll gears respectively non-rotatably connected to the first and second upper feed rolls and first and second upper roll drive gears non-rotatably mounted on the cross-shaft and respectively meshing with the first and second upper roll gears.

8 Claims, 3 Drawing Sheets

ROLL TYPE STOCK FEED APPARATUS

BACKGROUND OF THE INVENTION

The present invention relates to a roll type stock feed apparatus for simultaneously feeding at least two strips of stock in side by side relation at the same speed, and which can accommodate differences in the relative thickness of the stock strips.

Roll type stock feed apparatus have heretofore been made having a lower feed roll and an upper feed roll mounted on a upper roll carrier that is yieldably biased toward the lower feed roll to form a pinch pair, and in which both the lower and upper feed rolls are driven in timed relation to minimize slippage and provide more accurate feeding of stock, particularly during rapid acceleration and deceleration as occurs during intermittent stock feed. In U.S. Pat. No. 5,197,645, a single upper feed roll is mounted on the upper roll carrier. In U.S. Pat. No. 5,305,938, two upper roll members are attached to an upper roll shaft on the upper roll carrier and the lower feed roll is mounted for limited longitudinal tilting on the lower roll shaft.

It is sometimes desired to feed more than one strip of stock to a processing machine and, in order to accommodate multiple strips that may have relatively different thickness, roll type stock feed apparatus have heretofore been made, for example as disclosed in U.S. Pat. No. 4,043,494, having a power driven lower feed roll and a plurality of individual upper idler rolls that are resiliently pressed against the lower feed roll at spaced locations along the lower feed roll. However, when the upper feed rolls are not driven in timed relation with the lower feed roll, only the lower feed roll is effective to feed the strip, which feeding requires rapid acceleration and deceleration of the strip during intermittent feed, and this can adversely affect the accuracy of the feed of the multiple strips particularly at higher speeds.

SUMMARY OF THE INVENTION

It is an object of the present invention to pro-vide a roll type stock feed apparatus for simulta-neously feeding at least two strips of stock which can be of different thickness, in side by side relation at the same speed, and which minimizes slippage in feeding of the multiple strips of stock during acceleration and deceleration of the stock feed rolls, as occurs in intermittent stock feed.

Accordingly, the present invention provides a roll type stock feed apparatus for having a lower feed roll rotatably supported on the frame, a cross-shaft rotatably mounted on the frame parallel to the lower feed roll, and means for driving the lower feed roll and the cross-shaft in timed relation. First and second upper roll carriers are mounted for independent vertical pivotal movement on the cross-shaft, and first and second upper feed rolls are rotatably mounted on the upper roll carriers for movement therewith and are drivingly connected to the cross-shaft for rotation by the cross-shaft in timed relation with the lower feed roll. The first and second feed rolls are independently driven from the cross-shaft by first and second upper roll gears respectively non-rotatably connected to the first and second upper rolls, and first and second upper roll drive gears non-rotatably mounted on the cross-shaft and respectively meshing with the upper roll gears.

The roll carriers advantageously each include a gear casing enclosing the upper roll drive gear and the associated upper roll gear.

In some applications, it is desirable to move the upper feed rolls to a released condition during each press cycle to facilitate positioning of the stock by pilot pins relative to punch and die apparatus. A feed roll release mechanism is operatively connected to both the first and second upper roll carriers for simultaneously moving both the first and second upper feed rolls to a stock release condition.

DETAILED DESCRIPTION

Figure 1:
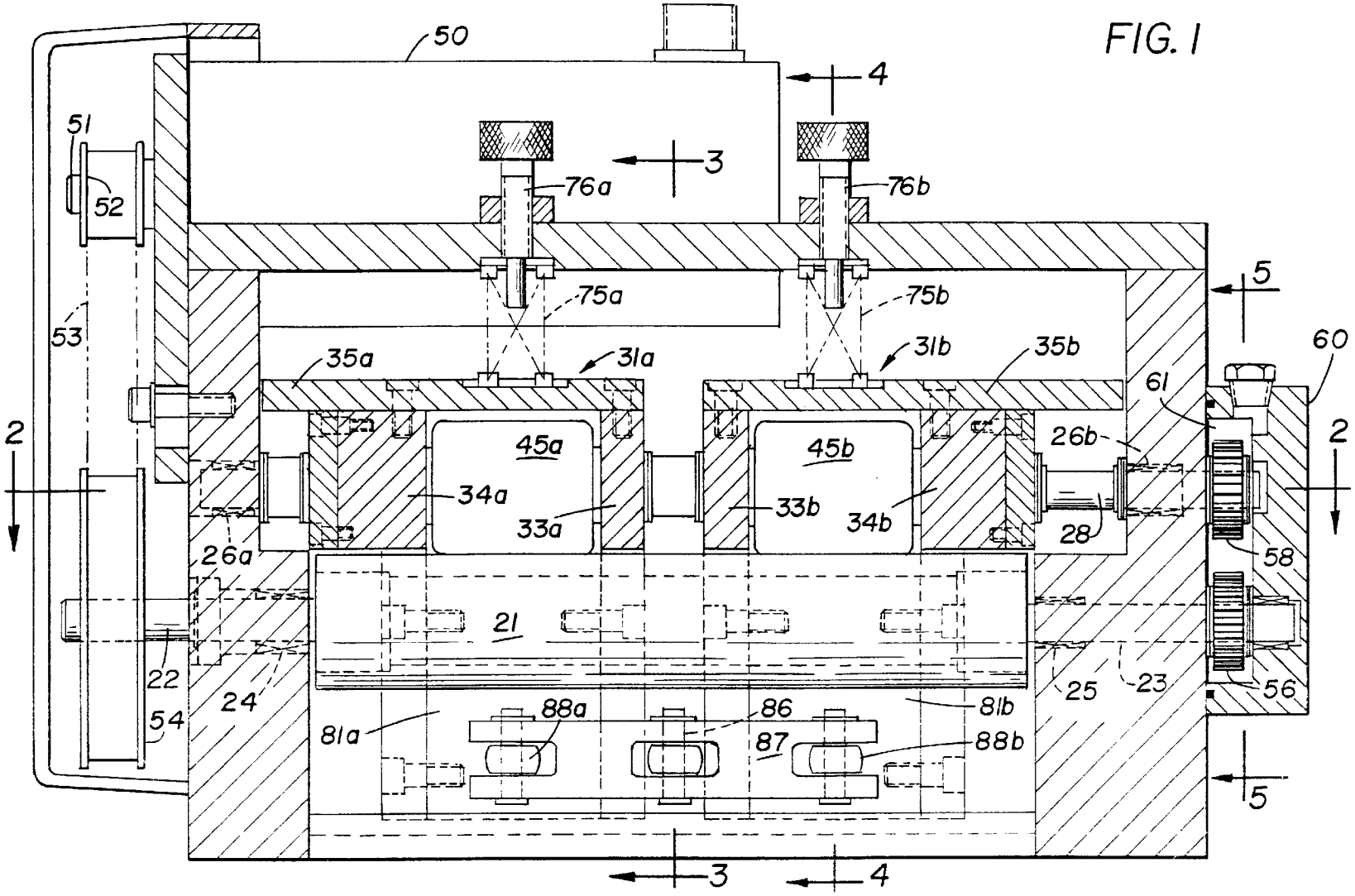
FIG. 1 is a vertical sectional view through the roll type stock feed apparatus.

The roll type stock feed apparatus in the present invention is adapted to intermittently advance two strips of stock in side by side relation to a power press (not shown) to enable the press to preform punch-ing and forming operations simultaneously on the two strips and thereby increase the overall productivity of the press. The stock strips can be of the same or different materials and can have the same thickness or relatively different thicknesses. The stock feed apparatus can also be used to feed a single wide strip, if desired.

The stock feed apparatus has a rigid stationary frame structure including spaced side members 10 and 11 that extend generally lengthwise of a stock feed path and which are rigidly interconnected by a bottom wall 12 and a top plate 13. Inlet and outlet cover plates 14 and 15 are provided at the inlet and outlet sides of the feed apparatus and are formed with inlet and outlet openings 14*a* and 15*a* to allow passage of stock through the stock feed apparatus.

A lower feed roll 21 has end portions or shafts 22 and 23 rotatably supported as by bearings 24 and 25 in the side members 10 and 11 for rotation about a horizontal axis. The lower feed roll preferably has a uniform outer diameter throughout its length as shown.

Figure 2:
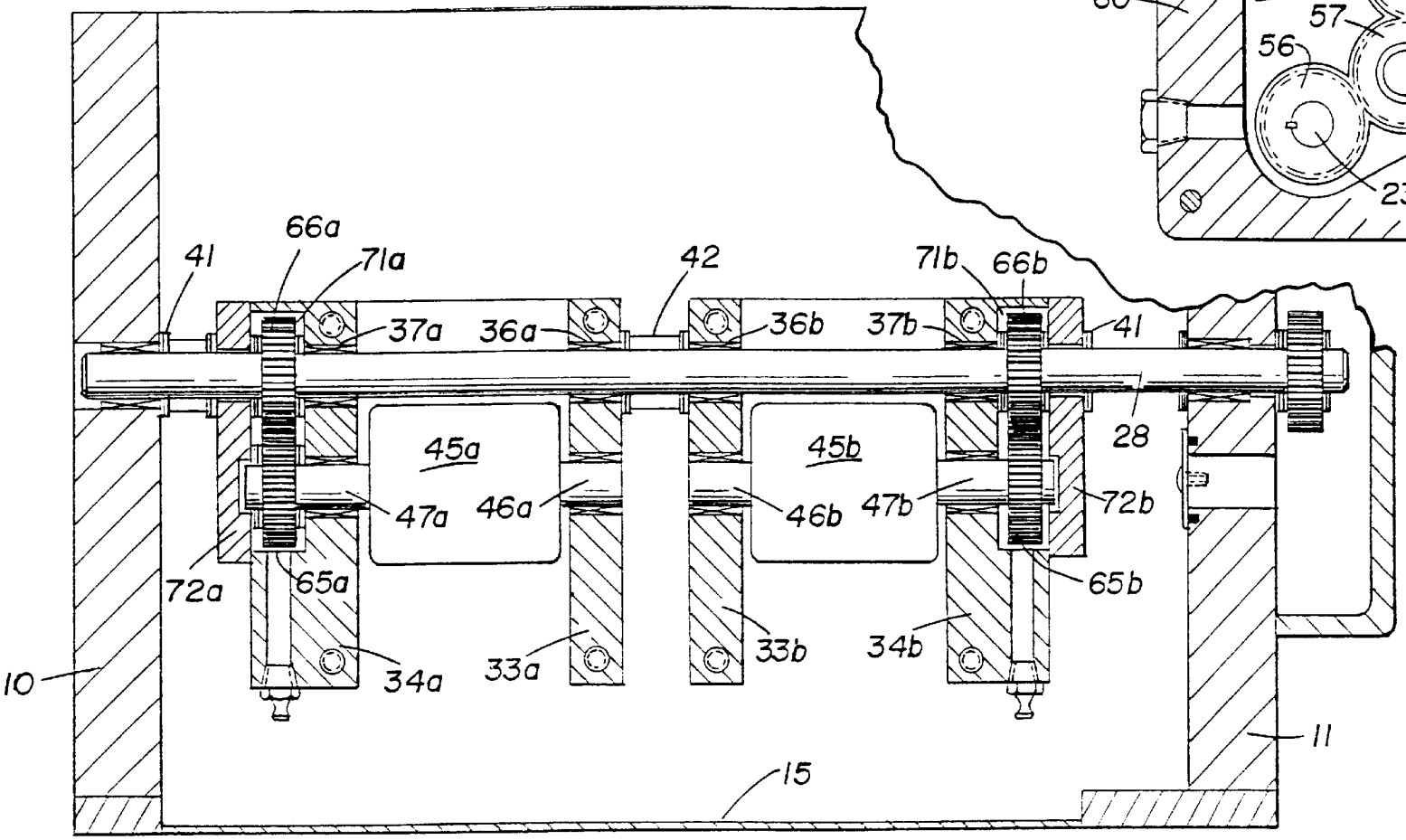
FIG. 2 is a horizontal sectional view taken on the plane 2—2 of FIG. 1.

A cross-shaft 28 is rotatably supported by bearings 26*a* and 26*b* in the side members 10 and 11 for rotation about an axis parallel to the axis of the lower feed roll 21. First and second upper roll carriers 31*a* and 31*b* are mounted for independent vertical pivotal movement on the cross-shaft 28 at locations spaced apart along the cross-shaft. The upper roll carriers 31*a* and 31*b* have spaced side members 33*a*, 34*a* and 33*b*, 34*b* respectively and the side members are rigidly interconnected by top members 35*a* and 35*b*. As best shown in FIG. 2, the cross-shaft 28 extends through bearings 37*b*, 36*b* in upper roll carrier 31*b* and through bearings 36*a*, 37*a* in the upper roll carrier 31*a*, and the upper roll carriers are maintained in positions along the cross-shaft 28 by suitable rings 41 and spacers 42. Upper feed rolls 45*a* and 45*b* are mounted on the upper roll carriers 31*a* and 31*b* respectively for rotation about axes parallel to the crossshaft 28 and at locations to engage the lower feed roller 21 in a vertical plane containing the axes of both the upper and lower feed rolls. The upper feed rolls 45*a* and 45*b* are short as compared to the lower feed roll 21 and engage the lower feed roll at spaced locations therealong. As best shown in FIG. 2, the upper feed roll 45*a* and 45*b* have shafts 46*a*, 47*a* and 46*b* and 47*b* respectively that are rotatably supported on the side members of the associated upper roll carrier.

Figure 5:
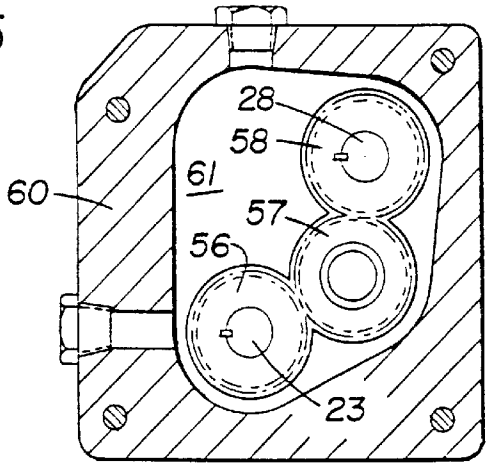
FIG. 5 is a fragmentary vertical sectional view taken on the plane 5—5 of FIG. 1.

A drive motor 50 such as a servo-motor or a stepper-motor is provided for driving the feed rolls. The drive motor is arranged to drive the lower feed roll 21 and the cross-shaft 28 in timed relation and in the same angular direction. In the embodiment illustrated, drive motor 50 has an output shaft 51 connected through a pulley 52 and a preferably toothed belt 53 to a pulley 54 on the end portion 22 of the lower feed roll 21. A gear 56 is non-rotatably mounted on one of the end portions 23 of the lower feed roll 21. As best shown in FIG. 5, gear 56 is drivingly connected through an idler gear 57 to a gear 58 non-rotatably secured to an end of the cross-shaft 28. Gears 56–58 are preferably located on the same side of the feed roll frame and enclosed in a casing 60 to provide chamber 61 for gear lubricant.

As best shown in FIG. 2, upper roll gears 65*a* and 65*b* are non-rotatably secured to shafts 47*a* and 47*b* on the upper rolls 45*a* and 45*b* respectively. Upper roll drive gears 66*a* and 66*b* are non-rotatably mounted on the cross-shaft 28 and respectively mesh with upper roll gears 65*a* and 65*b* to drive the upper feed rolls 45*a* and 45*b* in response to rotation of the cross-shaft. The gears 56–58 are arranged to drive the cross-shaft at the same angular speed as the lower feed roll and gears 65*a*, 66*a*, and 65*b*, 66*b* are arranged to drive the upper feed rolls at the same angular speed as the lower feed rolls and in a direction opposite the direction of rotation of the lower feed roll to advance strip stock therebetween.

The upper roll carriers 31*a* and 31*b* are configured to form gear casings to enclose the upper roll drive gears. As best shown in FIG. 2, side members 34*a* and 34*b* of the upper roll carriers are formed with cavities 71*a* and 71*b* for receiving the gears and cover plates 72*a* and 72*b* are attached to the side members 34*a* and 34*b* respectively to enclose the gears 66*a*, 65*a* and 66*b*, 65*b* respectively.

Figure 3:
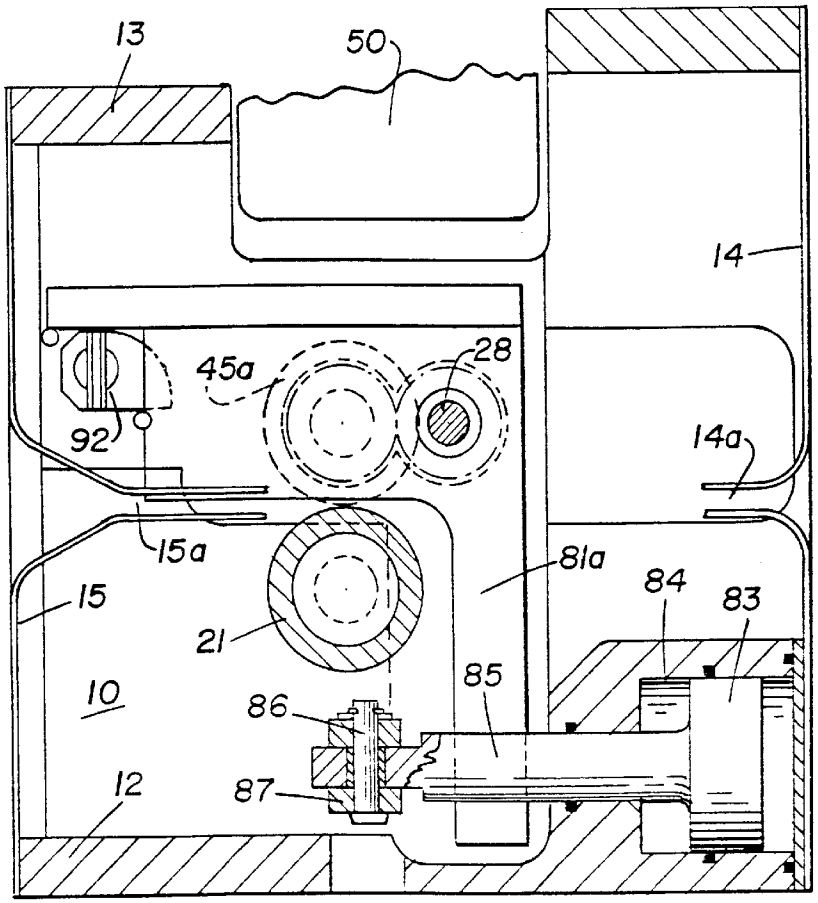
FIG. 3 is a vertical sectional view taken on the plane 3—3 of FIG. 1.
Figure 4:
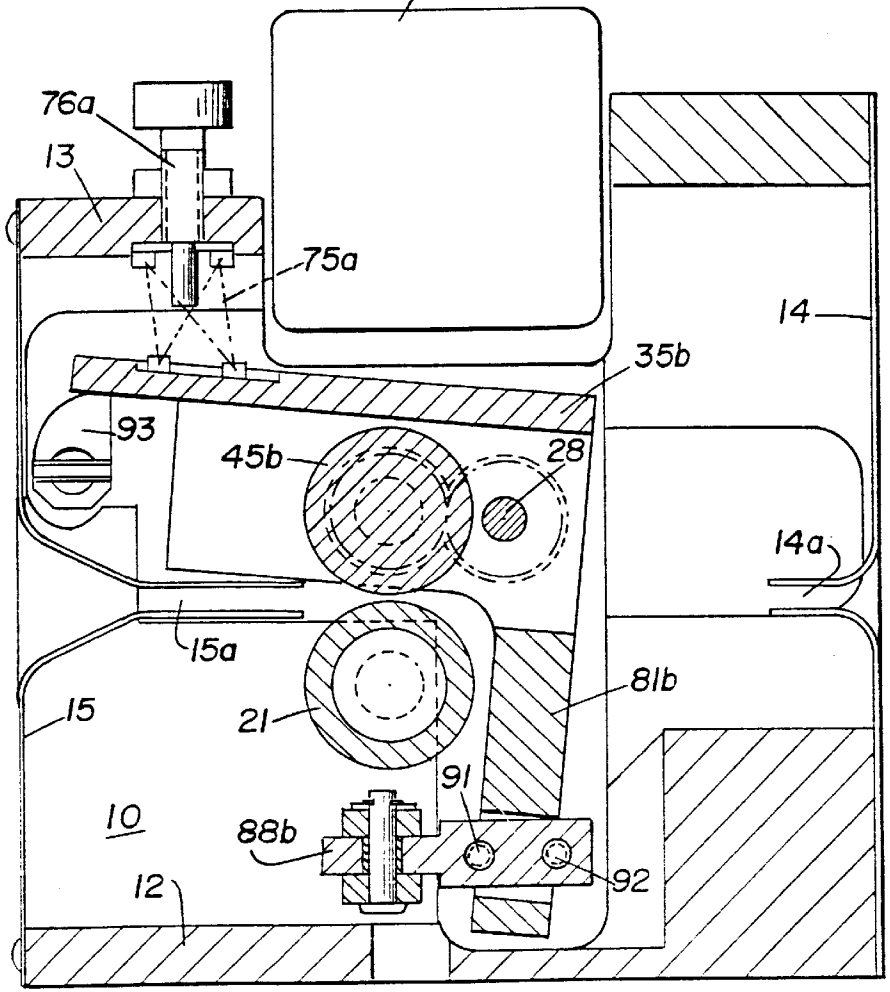
FIG. 4 is a vertical sectional view taken on the plane 4—4 of FIG. 1.

The upper roll carriers are individually yieldably biased in a direction to press the associated upper feed rolls into engagement with the lower feed rolls. In the embodiment illustrated, compression springs 75*a* and 75*b* respectively engage the upper roll carriers 31*a* and 31*b* and a means such as screws 76*a* and 76*b* are provided for adjusting the spring pressure. As is apparent, other means such as pneumatically actuated pistons or the like can be provided for adjustably bias in the feed rolls into engagement with the lower feed rolls. In some press operations, it is necessary to move the upper feed rolls to a released position during each press cycle to allow a pilot pin or pins to precisely position the stock in relation to the punch and forming dies. As shown in FIGS. 1–3, the roll carriers 31*a* and 31*b* have downwardly extending leg portions 81*a* and 81*b*. A feed roll release mechanism is arranged to engage the downwardly extending legs on both feed roll carriers to move the latter between a feed condition and a release condition. In the embodiment illustrated, the feed roll release mechanism includes a piston 83 slidable in a cylinder 84 and having a rod end 85 pivotally connected at 86 to a bar intermediate the ends of the latter. As shown in FIG. 1, opposite ends of the bar 87 are connected by links 88*a* and 88*b* to the depending legs 81*a* and 81*b* of the upper roll carriers 31*a* and 31*b* respectively. As shown in FIG. 4, the links extend through openings in the legs 81*a* and 81*b* and have stop pins 91 and 92 that engage opposite sides of the legs so that the piston 83 can positively move the roll carriers 35*a* and 35*b* from a feed condition as shown in FIG. 3 to release condition as shown in FIG. 4, and back to the feed condition. The piston 83 is operative, when fluid pressure is supplied to the cylinder 84 at one side of the piston 83, to shift both upper roll carriers in a clockwise direction as viewed in FIGS. 3 and 4, in opposition to the biasing springs 75*a* and 75*b*, to move the upper feed rolls to a release condition. When fluid pressure is applied to the other side of the piston 83, the feed rolls are moved back to the feed condition. Actuation of the piston 83 can be effected by a suitable valve (not shown)operated in timed relation with the press ram.

Manually operable cams 93 are provided to enable manual movement of the upper roll carriers 31*a* and 31*b* to a release condition, to facilitate threading of the stock to the stock feed apparatus.

From the foregoing it is believed that the construction and operation of the stock feed apparatus will be readily understood. Two strips of stock of the same or relatively different materials or thickness can be advanced by the upper and lower feed roll so that a press can simultaneously preform punching and forming operations on the two strips of stock in each cycle and increase the production capacity of the press accordingly. The lower feed roll and both upper feed rolls are driven so as to minimize slippage between the feed rolls and the stock during rapid acceleration and deceleration as occurs during intermittent stock feed. The upper roll carriers are mounted for independent vertical pivotal movement on the cross-shaft and are biased independently adjustable mechanisms in a direction to press the associated upper feed roll into feeding engagement with the stock, and both upper feed rolls are driven from the cross-shaft in timed relation with the lower feed roll. Driving both of the upper feed rolls in timed relation with the lower feed roll minimizes slippage during rapid acceleration and deceleration of the stock and enables the stock feed apparatus and press to be operated at higher speeds and also minimizes marring of the stock.

The embodiments of the invention in which an exclusive property or privilege is claimed are defined as follows:

1. A roll type stock feed apparatus comprising, a rigid frame, a lower feed roll rotatably mounted for axial rotation on the frame, a cross-shaft mounted for axial rotation on the frame parallel to said lower feed roll, first and second upper roll carriers mounted for independent vertical pivotal movement on the crossshaft at spaced locations along the cross-shaft, first and second upper feed rolls respectively mounted on the first and second upper roll carriers for rotation about axes parallel to the cross-shaft, first and second means respectively engaging the first and second upper roll carriers for pressing the first and second upper feed rolls in a direction toward the lower feed roll, drive means including a drive motor for driving the lower feed roll and the cross-shaft in timed relation, first and second upper roll gears respectively drivingly connected to the first and second upper feed rolls, and first and second upper roll drive gears mounted on the cross-shaft for rotation therewith and respectively meshing with the upper roll gears for driving the first and second upper feed rolls in response to rotation of the cross-shaft.

2. A roll type stock feed apparatus according to claim 1 wherein the first roll carrier includes a first gear casing enclosing the first upper roll drive gear and the first upper roll gear, the second roll carrier including a second gear casing for enclosing the second upper roll drive gear and second upper roll gear.

3. A roll type stock feed apparatus according to claim 2 wherein said drive means includes means drivingly connecting said drive motor to said lower feed roll, and gear means connecting said lower feed roll to the cross-shaft.

4. A roll type stock feed apparatus according to claim 1 including a feed roll release mechanism operatively connected to both the first and second upper roll carriers for moving the first and second upper feed rolls in a second direction to a release condition.

5. A roll type stock feed apparatus according to claim 1 wherein said drive means includes means drivingly connecting said drive motor to said lower feed roll, and gear means connecting said lower feed roll to the cross-shaft.

6. A roll type stock feed apparatus for advancing strip stock comprising, a rigid frame having spaced side members, a lower feed roll disposed between the side members and having axially extending shaft portions at opposite ends rotatable mounted in the on the side members, a cross-shaft extending between the side members parallel to said lower feed roll and having end portions rotatably mounted on the side members, first and second upper roll carriers mounted for independent vertical pivotal movement on the cross-shaft at locations between said side members and spaced apart along the cross-shaft, first and second upper feed rolls respectively mounted on the first and second upper roll carriers for rotation about axes parallel to the crossshaft, first and second means respectively engaging the first and second upper roll carriers for pressing the first and second upper feed rolls in one direction toward the lower feed roll, drive means including a drive motor for driving the lower feed roll and the cross-shaft in timed relation, first and second upper roll gears respectively non-rotatably connected to the first and second upper rolls, and first and second upper roll drive gears non-rotatably mounted on the cross-shaft and respectively meshing with the first and second upper roll gears for driving the first and second upper feed rolls in response to rotation of the cross-shaft.

7. A roll type stock feed apparatus according to claim 6 wherein said drive means includes means drivingly connecting said drive motor to said lower feed roll, and gear means connecting said lower feed roll to the cross-shaft.

8. A roll type stock feed apparatus according to claim 6 including a feed roll release mechanism operatively connected to both the first and second upper feed roll carriers for moving the first and second upper feed rolls in a second direction opposite aid first direction.

* * * * *

UNITED STATES PATENT AND TRADEMARK OFFICE

CERTIFICATE OF CORRECTION

PATENT NO. : 5,772,095

DATED : June 30, 1998

INVENTOR(S) : Richard D. Nordlof

It is certified that error appears in the above-identified patent and that said Letters Patent is hereby corrected as shown below:

In Claim 6, Column 5, Line 9 "rotatable mounted in the on the" should read --rotatably mounted on the--.

Signed and Sealed this

First Day of September, 1998

*Attest:*

*Attesting Officer*

BRUCE LEHMAN

*Commissioner of Patents and Trademarks*